US005379671A

United States Patent [19]

Kang

[11] Patent Number: 5,379,671

[45] Date of Patent: Jan. 10, 1995

[54] MAGNETIC SADDLE FOR NON-MAGNETIC DIE-CUTTING CYLINDERS

[75] Inventor: Pierson S. Kang, North Wales, Pa.

[73] Assignee: Xynatech, Inc., Rio Rancho, N. Mex.

[21] Appl. No.: 17,725

[22] Filed: Feb. 16, 1993

[51] Int. Cl.[6] ..... B26D 1/62; B26D 7/26

[52] U.S. Cl. ..... 83/698.11; 83/677; 83/698.51

[58] Field of Search ..... 83/698, 700, 343, 673, 83/674, 659, 677, 698.11, 698.51

[56] References Cited

U.S. PATENT DOCUMENTS

| | | | |
|---|---|---|---|
| 3,965,786 | 6/1976 | D'Luhy | 83/346 |
| 4,233,873 | 11/1980 | Jessen | 83/698 |
| 4,823,659 | 4/1989 | Falasconi | 83/698 |
| 5,003,854 | 4/1991 | Capdebosco | 83/698 |
| 5,027,509 | 7/1991 | Barben et al. | 83/343 |
| 5,088,367 | 2/1992 | Cracchiolo et al. | 83/700 |
| 5,230,271 | 7/1993 | Hardisty et al. | 83/698 |

FOREIGN PATENT DOCUMENTS

| | | | |
|---|---|---|---|
| 172158 | 12/1921 | United Kingdom | 83/673 |

*Primary Examiner*—Hien H. Phan
*Attorney, Agent, or Firm*—Anderson Kill Olick & Oshinsky

[57] ABSTRACT

A magnetic saddle apparatus for mounting magnetic etched dies onto rotating cylinders and including a segment of a cylinder wall, on an outer surface of which an array of permanent magnets is adhered, a mounting arrangement for fastening the saddle apparatus to a die-cutting cylinder, and a gripping bar, which prevents slippage of small area etched dies during operation of the cutting cylinder.

1 Claim, 2 Drawing Sheets

MAGNETIC SADDLE FOR NON-MAGNETIC DIE-CUTTING CYLINDERS

FIELD OF THE INVENTION

The present invention relates generally to cutting dies and more particularly to an apparatus and means for mounting etched cutting dies and primarily magnetic etched dies onto rotating cutting cylinders used on press lines in the printing and packaging industries for cutting shapes, openings, or perforations in paper, film or foil.

BACKGROUND OF THE INVENTION

The background of this invention is partly represented by U.S. Pat. Nos. 3,969,474, 3,000,237, 3,063,349, which disclose methods for forming steel cutting rules for either reciprocating flat bed, or rotary cylindrical press apparatus. In addition, the state of the art has progressed to include dies that are prepared by etching magnetic metals, such as spring steel or magnetic stainless steel. The etched dies are attached in rotary press lines to permanent magnet surfaced cylinders that are rotated in synchrony with other elements of the press line such as printing plate cylinders, glue applicators, etc.

The etching of dies is accomplished primarily by the use of photographic techniques in which the metal is first covered by a photosensitive lacquer or solid film etchant resistive material, which is then exposed to actinic rays through a photographic transparency containing an opaque image of the features of the die's cutting or forming surfaces. Etched magnetic dies are increasingly used in the printing, and packaging industries, not only because of the accuracy, reproducibility and the efficiency of etched die production, but also because etched dies are much more quickly prepared, since neither preparation of machined parts, bending with special tools, nor the fabrication of molds are required as they are in earlier steel rule die methods or in the technique disclosed in U.S. Pat. No. 3,969,474. U.S. Pat. No. 3,969,474 primarily addresses molded steel rule dies for rotary die cutting.

Speed of die preparation is of great importance to printing firms who often face operating deadlines with little detailed information until near press time. The photographic transparencies used to produce etched dies can be produced from computer aided design (CAD) which can be downloaded by modem to plotting devices which optically expose the pattern directly onto the photographic film. This technique further reduces the lead time required to produce etched dies.

Despite the several advantages of etched magnetic dies, the use has been limited primarily by the cost of magnetic cylinders. In typical magnetic cylinders, magnets of high magnetic strength, such as costly samarium-cobalt or neodymium cobalt permanent magnets, are closely arranged and permanently attached around a stainless steel cylindrical drum surface so that the etched dies may be placed anywhere on the surface and be firmly held in place so as not to shift during the actual cutting operation as paper or film passes between the cutting edge of the die on the rotating cylinder and anvils of various materials.

The use of magnetic dies has been even further limited by the economic consideration of the large number of already installed non-magnetic cylinders in rotary press lines and the familiarity of press operators with the methods of mounting molded dies to these cylinders. These non-magnetic cylinders typically contain a large plurality of tapped holes located on a regular pitch which may be used to bolt thin clamps which are used to hold molded dies in position utilizing ledges that are molded into the molded plastic portion of the dies.

It is therefore an object of the invention to provide an apparatus and means for the practical use of magnetic dies on non-magnetic cylinders.

Another object of the invention is to provide an apparatus and means for preventing slippage between magnetic dies and magnetic cylinders in the operating mode.

SUMMARY OF THE INVENTION

These and other objects of the invention, which shall become hereafter apparent, are achieved by a magnetic "saddle" or "saddles" suitable for mounting on a non-magnetic cylinder that has been provided on its surface, with a plurality of regularly spaced tapped holes or threaded inserts. The purpose of the magnetic saddle is to provide a surface with strong magnetic holding force to attach etched dies, formed from magnetic materials such as mild steel, tool steel, spring steel, or magnetic stainless steel.

The saddle concerns a machined part that is a segment of a cylinder wall fitted with several countersunk mounting through holes, positioned to align with the tapped holes in the non-magnetic cylinders, and containing, on its outer surface, a plurality of closely spaced high magnetic strength permanent magnets. The saddle is also provided with at least three (3) tapped holes or threaded inserts to be used in cooperation with a bolt as a height adjustment and leveling device.

The saddle may be cut from precision tubing, but preferably may be machined in the flat and then bent on a rolling device to form the segment of a cylinder wall. In order to accomplish ease of bending and yet obtain a saddle of sufficiently substantial thickness for the strength required in handling in a pressroom, the underside of the saddle is machined to produce channels parallel to the axis of the cylinder to which it will be mounted. The channels are typically rectangular in cross-section and are most easily machined in the saddle while it is in the developed flat form. In addition to facilitating bending, the channels also promote precise mounting of the saddle to the cylinder.

The permanent magnets are adhered to the outer surface of the saddle, with a structural adhesive of the epoxide type, while the saddle is mounted on and bolted to a non-magnetic tool-cylinder that has been carefully machined to within ±0.0002 inches of nominal diameter. This cylinder is typically fabricated of solid tool steel so that it may be used to produce large number of saddles of that particular cylinder diameter, while resisting deformation during the process of magnetic saddle manufacture. The tool-cylinder is machined with equally accurate journals, approximately one-third the tool-cylinder diameter, in order that the tool cylinder with saddle mounted and permanent magnets with cured adhesive adhered to the saddle, may be mounted on an engine lathe fitted with a grinding tool. As the assembly rotates on the lathe, the grinding head surfaces all the magnets to an identical radius from the center of the cylinder. When all the magnet outer surfaces have been ground to a common cylinder radius, the saddle is unbolted from the tool-cylinder and is ready for mounting on a press room, non-magnetic, production cylinder.

In many applications, the dies are of sufficient size that the area of contact with the magnetic surfaces produces enough strength to prevent lateral or circumferential slippage between the die and the magnets during operation of the die against an anvil. In applications where dies are small and slippage may occur, the present invention provides a gripping bar. The etched die is provided with an extra area on its base, which may be bent into a tab. The tab is captured between the gripping bar and the saddle and the gripping bar is bolted to the saddle.

BRIEF DESCRIPTION OF THE DRAWINGS

The invention will be better understood by the Detailed Description of the Preferred Embodiment, in connection with the drawings, of which:

FIG. 3-A is a perspective view of this same die with a bent tab used in cooperation with the gripper bar shown as part of the magnetic saddle in FIG. 2.

DETAILED DESCRIPTION OF THE PREFERRED EMBODIMENT

Figure 1:
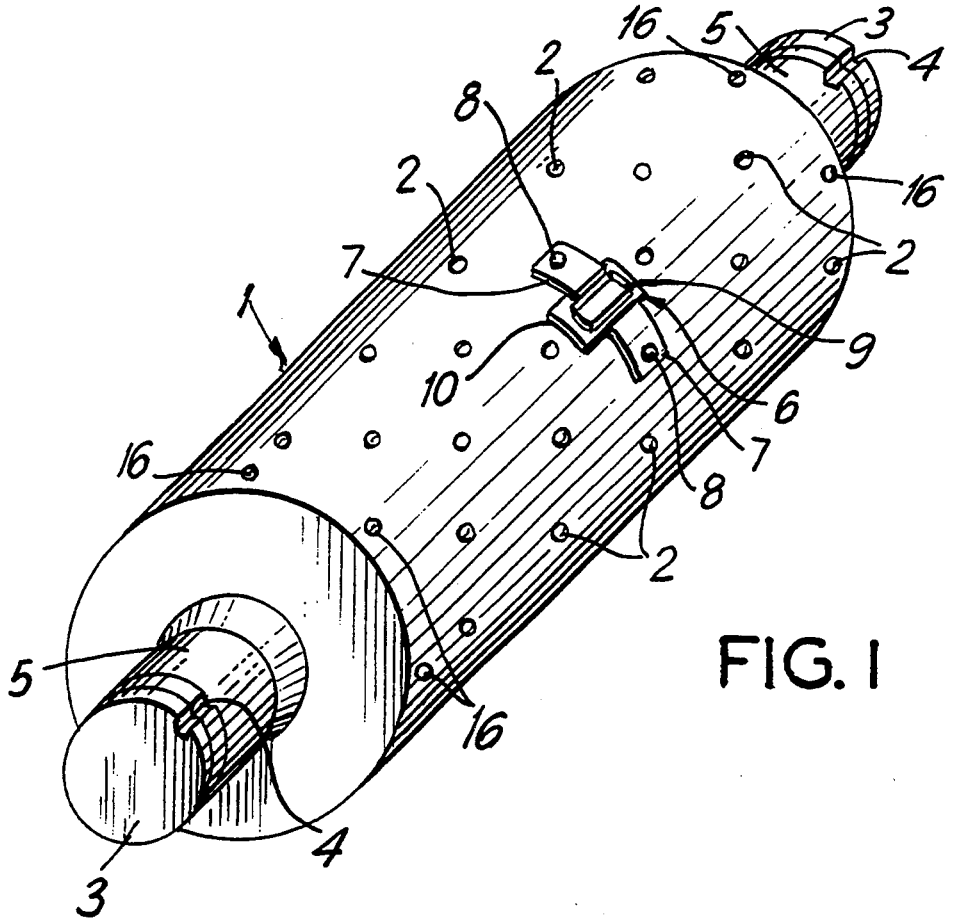
FIG. 1 is a perspective view of a typical non-magnetic cylinder showing the arrangement of rows of equally spaced tapped holes, parallel to the center line of the cylinder, and showing the substantial journal diameter in relation to the cylinder diameter.

Referring now to the drawings, wherein like numerals reflect like elements, throughout the several views, FIG. 1 depicts a non-magnetic rotary die-cutting mounting cylinder 1 which is installed in a rotary die-cutting machine and comprises a plurality of tapped holes 2 arranged in regular patterns on the cylinder, a pair of journals 3, each containing key locking slots 4 for attachment of gears or timing belt pulleys and bearing mounting areas 5. In conventional die-cutting machine practice, moulded dies are mounted on the cylinder surface in appropriate positions for die-cutting the product being produced in the corresponding positions on the product and are held in place by clamps or "dogs" 7 and bolts 8. The underside of the moulded die 6 is curved to intimately cooperate with the curvature of the cylinder 1.

Figure 3:
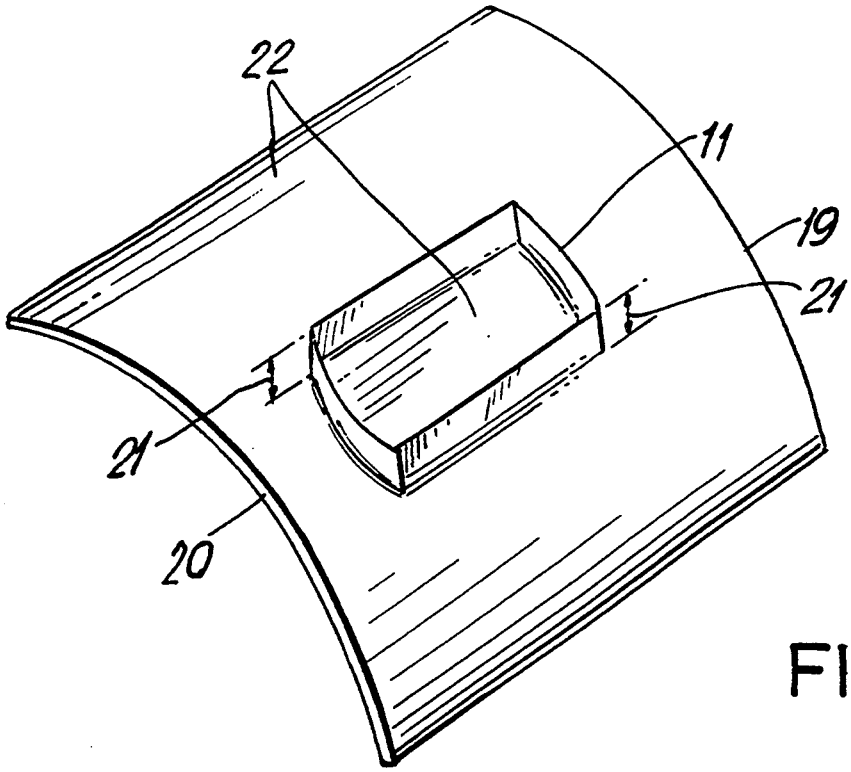
FIG. 3 is a perspective view of a typical magnetic die.
Figure 3A:
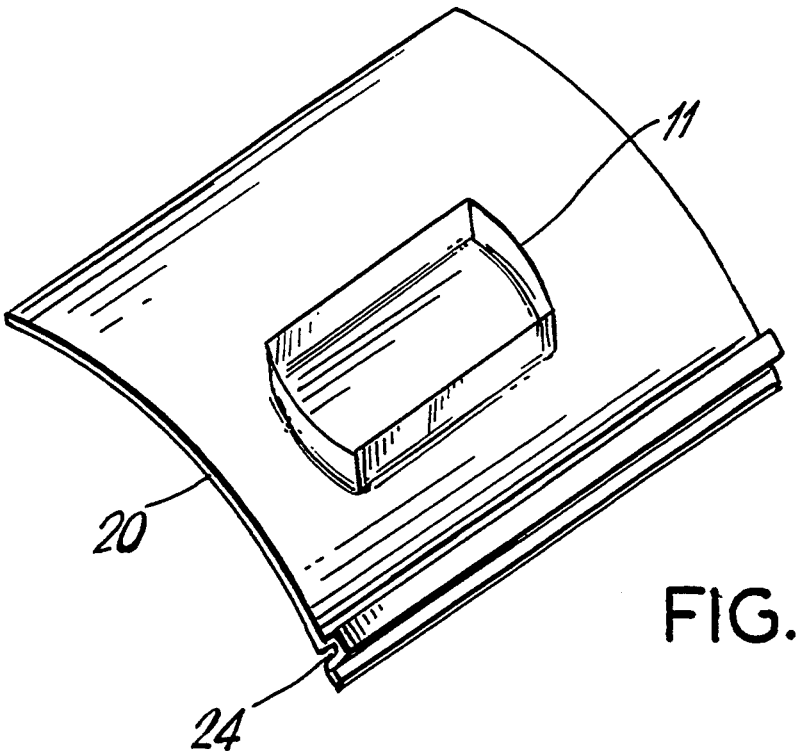

Continuing with FIG. 1, the cutting rule 9 embedded in moulded plastic 10 would cut an opening in paper, foil or cardboard equivalent in shape to the etched die shown in FIG. 3 and FIG. 3*a*. Cutting edge 11 has the same general shape as the cutting edge 9 in FIG. 1. These shapes are shown only as illustrative simple examples, and it should be obvious that many other shapes of die-cutting edges are possible, particularly by the etching method which is not limited by metal bending, metal joining and plastic moulding techniques.

Figure 2:
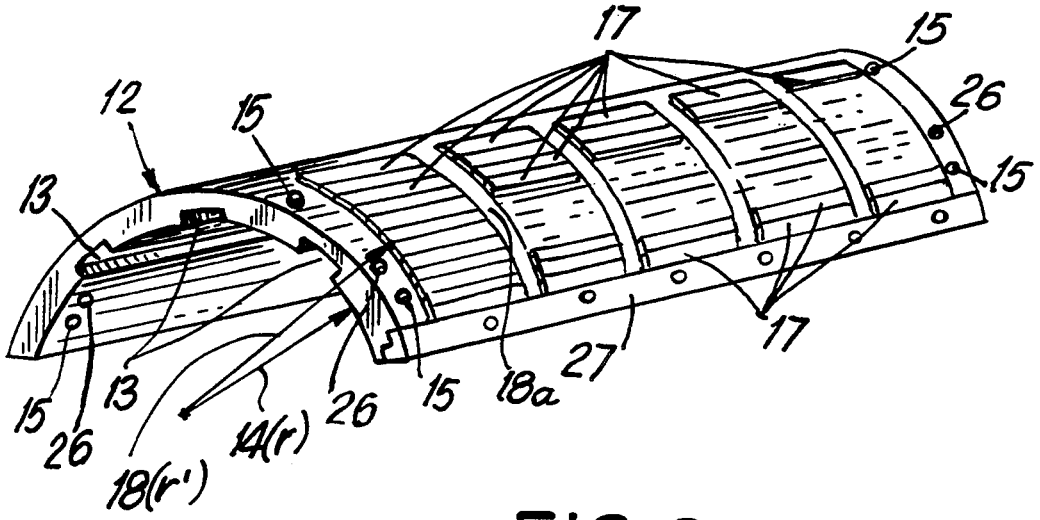
FIG. 2 is a perspective view of a magnetic saddle, suitable for mounting on the non-magnetic cylinder illustrated in FIG. 1.

Referring to FIG. 2, there is shown a curved plate-saddle 12, with machined longitudinal slots 13 provided to assist bending from the prior flat conformation. The imaginary radius r 14 of the curvature of the saddle is selected to be equal to the radius of the cylinder 1 of FIG. 1. The countersunk clearance holes 15 are positioned to align with tapped holes 16 in the cylinder 1 in order that the saddle 12 may be fastened to the cylinder 1 by means of threaded bolts. In addition, at least three threaded inserts or tapped holes 26 are provided for insertion of leveling and height adjusting jack-screws. The majority of the outer surface area of the saddle 12 is covered with permanent magnets 17 which have been machine ground to a common imaginary radius r′ 18. The surface of the saddle is thus suitable for mounting magnetic etched dies as illustrated in FIG. 3, which shows a die 19 with a cutting edge 11 suitable for cutting a roughly rectangular shape. Prior to etching, the metal thickness was equal to the sum of the die base thickness 20, plus the cutting edge length 21. It will be understood that the balance of surface metal has been removed by etching down to the surface 22 remaining. Typically for paper cutting, magnetic cutting dies are etched from metal stock of 0.016 inches in thickness or 0.018 inches in thickness, or 0.023 inches in thickness, or 0.032 inches in thickness, these being commonly available gauges of various magnetic sheet steels. Obviously many other thicknesses are possible for this die-cutting technique. The base thickness 20 however must be etched to approximately 0.006 inches to permit ease of shaping to the outer curvature 18 of the magnetic saddle 12. Thus, the height of the cutting edge 21 is nominally equal to the thickness of the starting material thickness, minus the actual thickness of the nominal 0.006 inch thick remaining base 20.

Referring to FIG. 3*a* and again to FIG. 3, an otherwise identical etched magnetic die has been bent to form a convoluted tab 24. The tab 24 is intended for insertion between a gripping bar 27 of FIG. 2 and the adjacent array of permanent magnets 17. This arrangement in which the die is restrained, both centrifically by the magnets 17 and circumferentially by the gripping bar 26, prevents movement in operation even when only a few magnets are opposed by a small magnetic-die base 22.

While the preferred embodiment of the invention has been presented in detail, various modifications and adaptations may be made thereto, without departing from the spirit and scope of the invention, as delineated in the following claims:

What is claimed is:

1. A magnetic saddle apparatus, comprising:

a segment of the wall of a cylinder;

an array of permanent magnets adhered to said wall;

mounting means for fastening said saddle apparatus to a die-cutting cylinder;

longitudinal channels on its underside to assist bending compliance to the die-cutting cylinder;

a gripping bar to prevent slippage of small area etched dies during operation of the die-cutting cylinder;

height and level adjusting screws;

longitudinal channels on its underside to assist compliance to a cylinder to which it is to be mounted; and a gripping bar to prevent slippage of small area etched dies.

* * * * *